US009197003B2

(12) United States Patent
Ito et al.

(10) Patent No.: US 9,197,003 B2
(45) Date of Patent: Nov. 24, 2015

(54) CONNECTOR AND COATING MEMBER USED FOR THE SAME

(71) Applicant: YAZAKI CORPORATION, Minato-ku, Tokyo (JP)

(72) Inventors: Yuichi Ito, Makinohara (JP); Shinji Kodama, Makinohara (JP); Takashi Muro, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/184,970

(22) Filed: Feb. 20, 2014

(65) Prior Publication Data

US 2014/0170901 A1 Jun. 19, 2014

Related U.S. Application Data

(63) Continuation of application No. PCT/JP2012/005445, filed on Aug. 29, 2012.

(30) Foreign Application Priority Data

Aug. 30, 2011 (JP) ..... 2011-187515

(51) Int. Cl.
*H01R 13/52* (2006.01)

(52) U.S. Cl.
CPC ..... *H01R 13/52* (2013.01); *H01R 13/521* (2013.01)

(58) Field of Classification Search
CPC ..... H01R 13/5221; H01R 13/5205; H01R 13/5208; H01R 13/521
See application file for complete search history.

(56) References Cited

U.S. PATENT DOCUMENTS

| | | | | |
|---|---|---|---|---|
| 5,580,264 | A * | 12/1996 | Aoyama et al. | 439/275 |
| 6,250,962 | B1 * | 6/2001 | Shinozaki | 439/587 |
| 6,383,022 | B1 * | 5/2002 | Murakami et al. | 439/589 |
| 6,494,740 | B1 * | 12/2002 | Murakami et al. | 439/587 |
| 6,527,574 | B1 * | 3/2003 | Murakami et al. | 439/275 |
| 6,752,659 | B2 * | 6/2004 | Nakamura et al. | 439/587 |
| 7,252,547 | B2 * | 8/2007 | Nishide | 439/587 |

(Continued)

FOREIGN PATENT DOCUMENTS

| | | | |
|---|---|---|---|
| CN | 1619891 | A | 5/2005 |
| CN | 201408893 | Y | 2/2010 |

(Continued)

OTHER PUBLICATIONS

Communication dated Jun. 2, 2015 from the Japanese Patent Office in Counterpart Application No. 2011-187515.

(Continued)

*Primary Examiner* — Gary Paumen
(74) *Attorney, Agent, or Firm* — Sughrue Mion, PLLC

(57) ABSTRACT

A connector includes a housing formed with a plurality of terminal insertion holes into which a plurality of terminal metal fittings is inserted, respectively, and a spacer arranged inside the housing and coating the plurality of terminal metal fittings. The spacer includes main bodies fixed inside the housing, and a plurality of slit doors provided in the main bodies and divided into a plurality of small pieces by a plurality of slits. Each of the slit doors elastically deforms by abutting a terminal metal fitting inserted into a terminal insertion hole when the terminal metal fitting passes therethrough, and is brought into contact with the terminal metal fitting when the terminal metal fitting is attached to the housing.

6 Claims, 9 Drawing Sheets

(56) References Cited

U.S. PATENT DOCUMENTS

| | | | | |
|---|---|---|---|---|
| 2002/0119690 | A1* | 8/2002 | Nakamura et al. | 439/275 |
| 2005/0106916 | A1 | 5/2005 | Nomura | |

FOREIGN PATENT DOCUMENTS

| | | | |
|---|---|---|---|
| JP | 09-092385 | A | 4/1997 |
| JP | 09-245880 | A | 9/1997 |
| JP | 11-111382 | A | 4/1999 |
| JP | 2000-223205 | A | 8/2000 |
| JP | 2011-003356 | A | 1/2011 |

OTHER PUBLICATIONS

Communication dated Jul. 2, 2015 from the State Intellectual Property Office of the People's Republic of China in counterpart application No. 201280041522.5.

* cited by examiner

CONNECTOR AND COATING MEMBER USED FOR THE SAME

CROSS REFERENCE TO RELATED APPLICATION

This is a continuation application based on PCT application No. PCT/JP2012/005445 filed on Aug. 29, 2012, which claims the benefit of priority from Japanese Patent Application No. 2011-187515 filed on Aug. 30, 2011, the entire contents of which are incorporated by reference herein.

BACKGROUND OF THE INVENTION

1. Field of the Invention

The present invention relates to a connector including a housing formed with a plurality of terminal insertion holes into which a plurality of terminals is inserted, and a coating member used for the connector.

2. Description of the Related Art

There is conventionally known a technique of providing a rubber packing in an engaging and connecting portion between a male connector and a female connector to prevent the entry of moisture into the connector (refer to, for example, Japanese Patent Application Laid-Open Publication No. 2011-003356 (pages 2 to 4, FIGS. 1 and 2)).

In this connector, in addition to the rubber packing, a sealing member (so-called rubber stopper) is crimped onto an outer circumference of a terminal metal fitting inserted into a terminal insertion hole formed in a housing of the connector. This can prevent the entry of moisture into the connector (especially, the terminal metal fitting) more reliably.

However, since the above-mentioned conventional connector is provided with the rubber packing and the sealing member, to suppress the corrosion and the like of the terminal within the connector, the connector is overspecified compared to a non-waterproof connector, which leads to an increase in manufacturing costs of the connector. Especially, the sealing member needs to be crimped to each terminal metal fitting, which significantly increases the manufacturing costs of the connector.

SUMMARY OF THE INVENTION

An object of the present invention is to provide a connector capable of reducing the manufacturing costs and preventing the entry of moisture into the connector, and a coating member used for the connector.

According to a first aspect of the present invention, there is provided a connector including a housing formed with a plurality of terminal insertion holes into which a plurality of terminals is inserted, respectively, and a coating member arranged inside the housing and coating the plurality of terminals, wherein the coating member includes a main body fixed inside the housing, and a plurality of slit doors provided in the main body and divided into a plurality of small pieces by a plurality of slits, and wherein each of the slit doors elastically deforms by abutting the terminal inserted into the terminal insertion hole when the terminal passes therethrough, and is brought into contact with the terminal when the terminal is attached to the housing.

In the connector according to the first aspect of the present invention, each of the slit doors elastically deforms by abutting the terminal inserted into the terminal insertion hole when the terminal passes therethrough, and is brought into contact (close contact) with the terminal when the terminal is attached to the housing. For this reason, the entry of moisture into the connector (in particular, the terminals) can be prevented by means of the coating member without using the conventional rubber packing and sealing member. As a result, since there is no need to crimp the sealing member and the like to each of the terminals, corrosion and the like of the terminals inside the connector is suppressed (so-called anti-corrosion), which prevents overspecification. In addition, since the conventional operation of attaching the rubber packing and the sealing member is not required, manufacturing costs for the connector can be reduced.

Moreover, each of the slit doors is divided into the plurality of small pieces by the slit. Thereby, since the slit doors can be easily deformed, the terminals are easy to pass through the slit doors. For this reason, the terminals can be easily inserted into the terminal insertion holes, thereby facilitating the operation of attaching the terminals to the housing.

According to a second aspect of the present invention, the main body is made of a resin material, and the plurality of slit doors is made of a rubber material.

In the connector according to the second aspect of the present invention, the main body is made of a resin material, and the plurality of slit doors is made of a rubber material. Thus, since the relatively inexpensive materials can be adopted, the manufacturing costs for the connector can be further reduced.

According to a third aspect of the present invention, the coating member is formed of a front-side coating member (front-side spacer 30A) arranged on a front-side in an inserting direction of the terminals, and a back-side coating member (back-side spacer 30B) arranged on a back-side in the inserting direction of the terminals with respect to the front-side coating member.

In the connector according to a third aspect of the present invention, the coating member is formed of the front-side coating member and the back-side coating member. The front-side coating member can prevent the entry of moisture from the openings of the terminal insertion holes, and even when the moisture passes through the front-side coating member, the back-side coating member can prevent the entry of the moisture. For this reason, corrosion and the like of the terminals inside the connector can be suppressed more reliably.

According to a fourth aspect of the present invention, there is provided a coating member including a main body fixed inside a housing of a connector, and a plurality of slit doors provided in the main body and divided into a plurality of small pieces by a plurality of slits, wherein each of the slit doors elastically deforms by abutting a terminal inserted into a terminal insertion hole of the connector when the terminal passes therethrough, and is brought into contact with the terminal when the terminal is attached to the housing.

According to the aspects of the present invention, it is possible to provide a connector capable of reducing the manufacturing costs and preventing the entry of moisture into the connector, and a coating member used for the connector.

DESCRIPTION OF THE EMBODIMENTS

Figure 1:
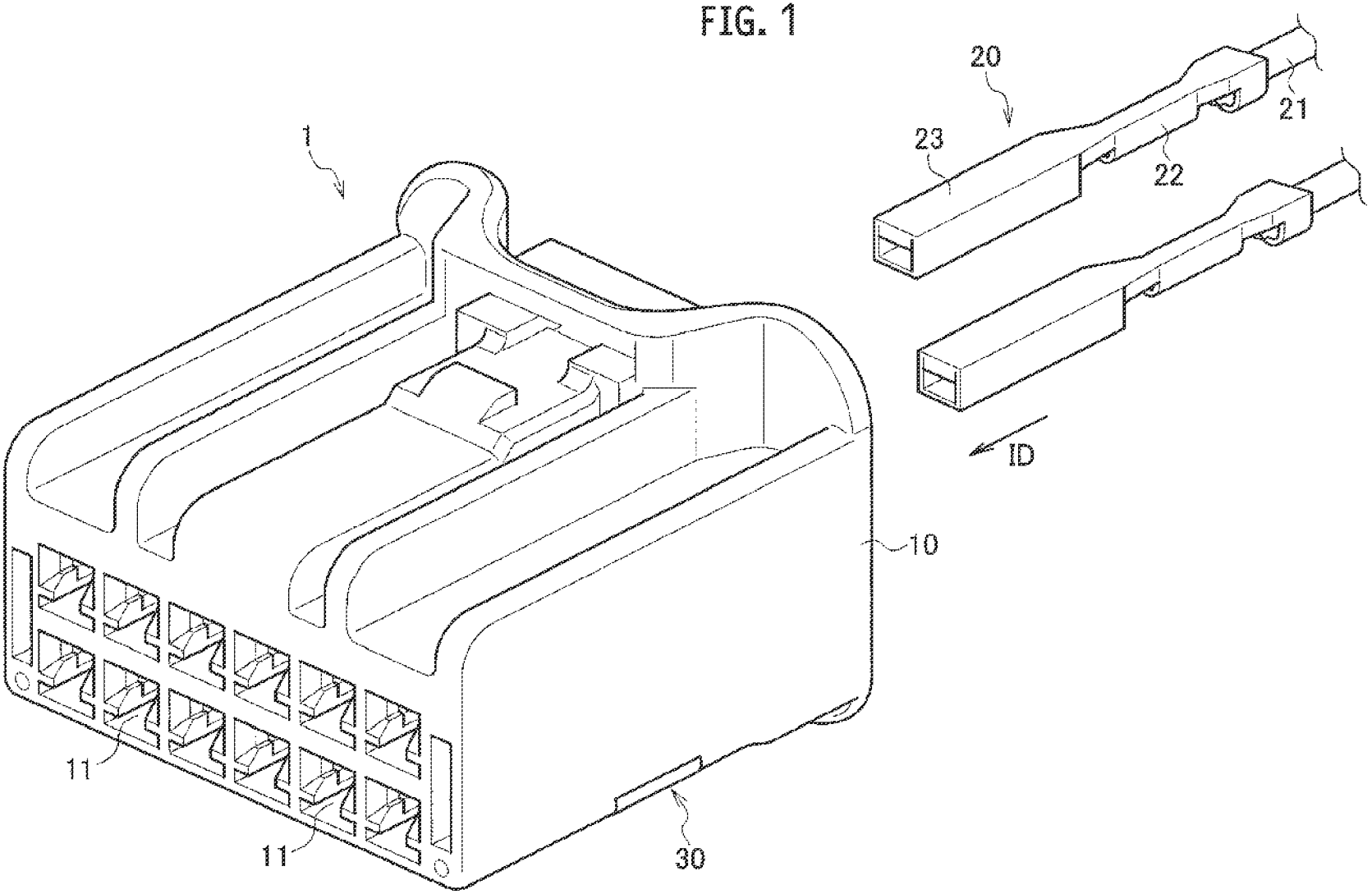
FIG. 1 is a perspective view of a connector 1 in accordance with the present embodiment when viewed from above.

Next, an embodiment of a connector according to the present invention will be described with reference to the drawings. Specifically, (1) configuration of connector, (2) configuration of spacer, (3) movement of slit doors, (4) actions and effects, and (5) other embodiments will be described in this order.

Note that, in the following description in the drawings, the same or similar parts are given the same or similar reference numerals. However, the drawings are schematic and thus, size ratio of each part or the like is different from the actual one.

Therefore, specific size or the like should be determined in consideration of the following description. Further, dimensional relationship or ratio between parts may vary between the drawings.

(1) Configuration of Connector

Figure 2:
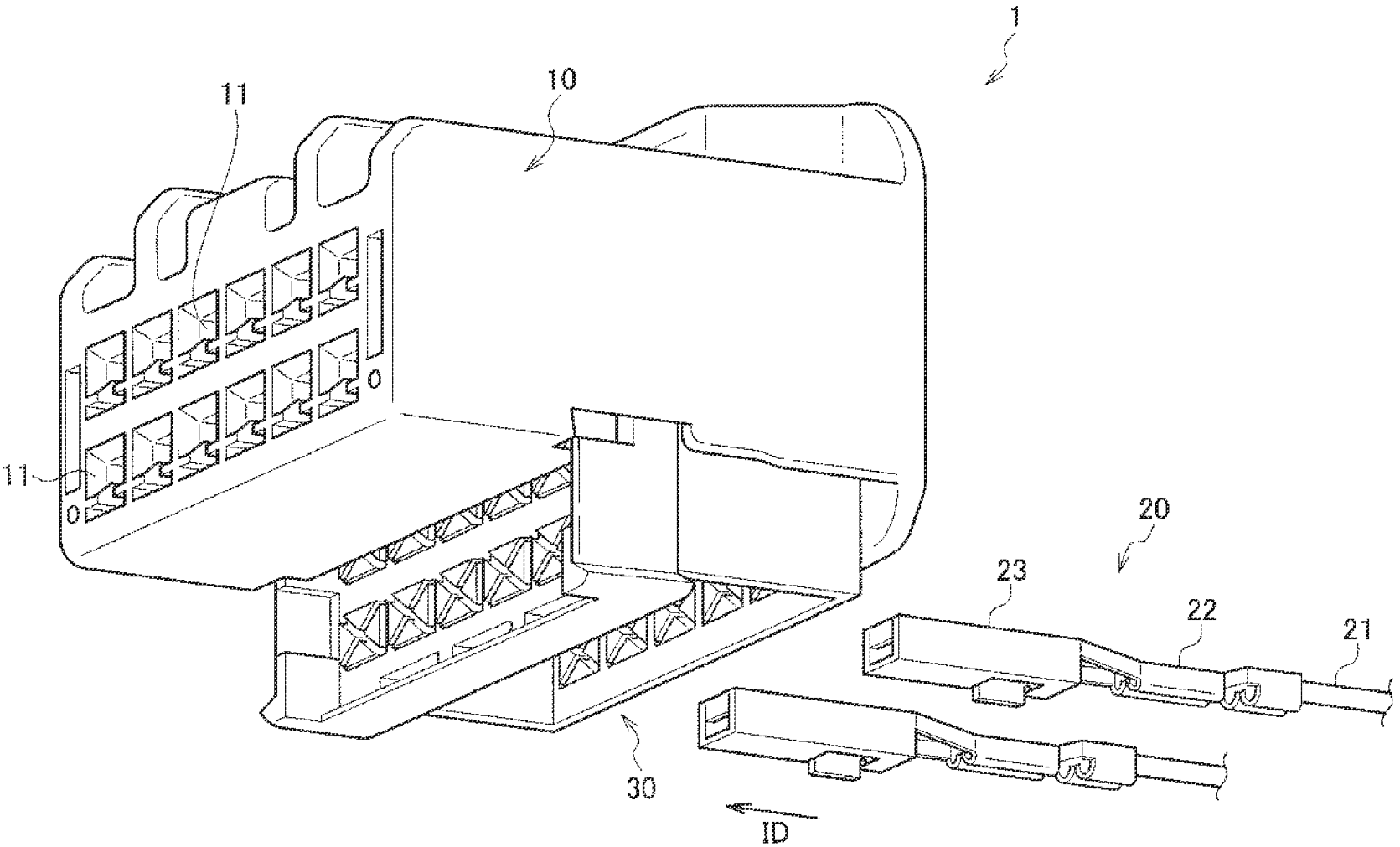
FIG. 2 is a perspective view of the connector 1 in accordance with the present embodiment when viewed from below.
Figure 3:
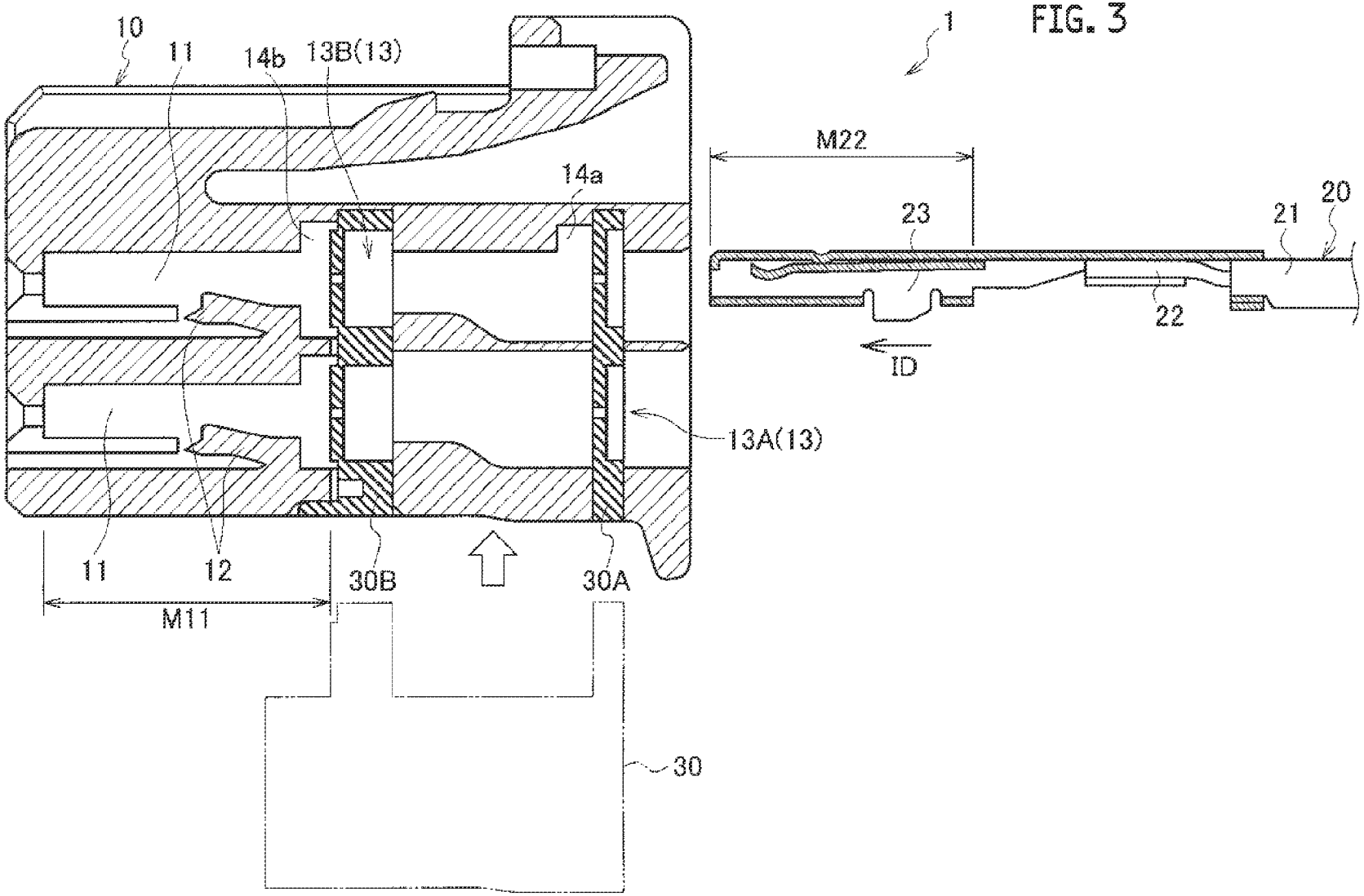
FIG. 3 is a sectional view of the connector 1 in accordance with the present embodiment.

First, a configuration of a connector 1 in accordance with the present embodiment will be described with reference to the figures. FIG. 1 is a perspective view of a connector 1 in accordance with the present embodiment when viewed from above. FIG. 2 is a perspective view of the connector 1 in accordance with the present embodiment when viewed from below. FIG. 3 is a sectional view of the connector 1 in accordance with the present embodiment. The connector 1 in accordance with the present embodiment is a female connector, and engages with a corresponding male connector (not shown).

As shown in FIG. 1 to FIG. 3, the connector 1 includes a housing 10 made of synthetic resin, a plurality of terminal metal fittings 20 connected to respective terminals of a plurality of electrical wires 21 to be attached to the housing 10, and a spacer 30 as a coating member attached to the housing 10 to prevent the entry of moisture into each of the terminal metal fittings 20.

The housing 10 is formed with a plurality of terminal insertion holes 11 into which the respective terminal metal fittings 20 are inserted. Each of the terminal insertion holes 11 passes through a side surface of the housing 10 in an inserting direction ID of the terminal metal fittings 20, and is substantially rectangular in a side view of the housing 10. On a back side of the terminal metal fitting 20 in the inserting direction ID in the terminal insertion hole 11, a lance 12, which cantilevers toward the back side and elastically deforms, is provided (refer to FIG. 3). When the terminal metal fitting 20 inserted into the terminal insertion hole 11 is attached inside the housing 10, the lance 12 is engaged with the terminal metal fitting 20.

Furthermore, the housing 10 is formed with a spacer storage chamber 13 that stores the spacer 30. The spacer storage chamber 13 is provided on the front side in the inserting direction ID of the terminal metal fitting 20 with respect to the lance 12, and is opened to a lower surface of the housing 10. The spacer storage chamber 13 includes a front-side storage portion 13A arranged on the front-side in the inserting direction ID of the terminal metal fittings 20, and a back-side storage portion 13B arranged on the back side in the inserting direction ID of the terminal metal fittings 20 with respect to the front-side storage portion 13A.

A plurality of door deformable spaces 14*a* where a plurality of below-mentioned slit doors 32A of the spacer 30 can deform is provided on the back-side in the inserting direction ID of the terminal metal fitting 20 in the front-side storage portion 13A. Similarly, a plurality of door deformable spaces 14*b* where a plurality of below-mentioned slit doors 32B of the spacer 30 can deform is provided on the back side in the inserting direction ID of the terminal metal fitting 20 in the back-side storage portion 13B.

Each of the terminal metal fittings 20 is fixed to a terminal of each of the electrical wires 21. The terminal metal fitting 20 is provided with a caulked portion 22 caulked onto the terminal of the electrical wire 21, and a prismatic front crimped portion 23 that is located closer to a front end than the caulked portion 22 and crimped to a connecting portion (not shown) of a corresponding male connector. The front crimped portion 23 is formed to be larger than the caulked portion 22, and when the terminal metal fitting 20 is attached to the housing 10, the front crimped portions 23 are engaged with the respective lances 12 on the back-side of the terminal insertion holes 11.

Here, as shown in FIG. 3, a depth dimension M11 of the terminal insertion holes 11 located on the back side in the inserting direction ID of the terminal metal fittings 20 with respect to the spacer storage chamber 13 is formed to be larger than a longitudinal dimension M22 of the front crimped portions 23 of the terminal metal fittings 20.

(2) Configuration of Spacer

Figure 4:
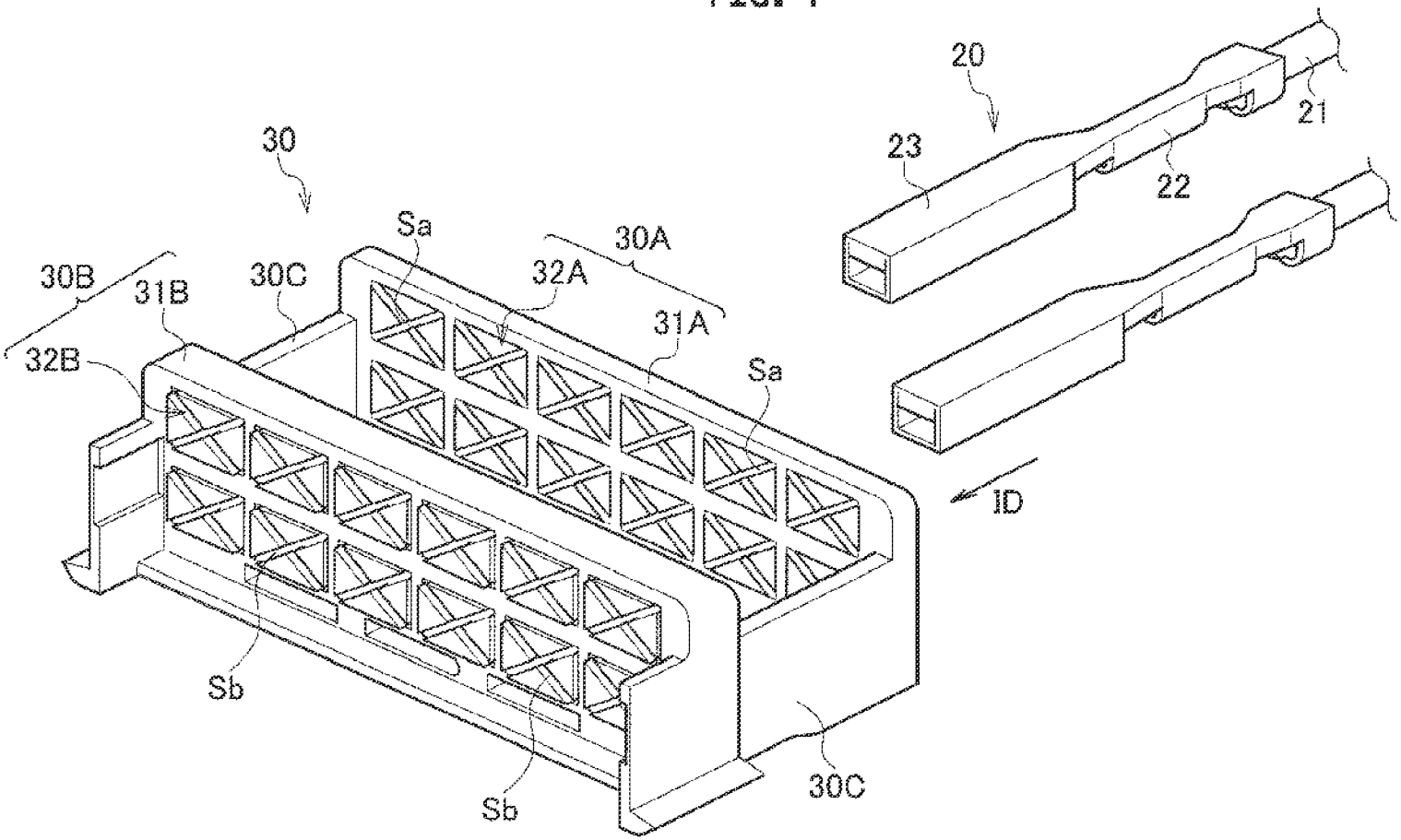
FIG. 4 is a perspective view showing a spacer 30 in accordance with the present embodiment.
Figure 5A:
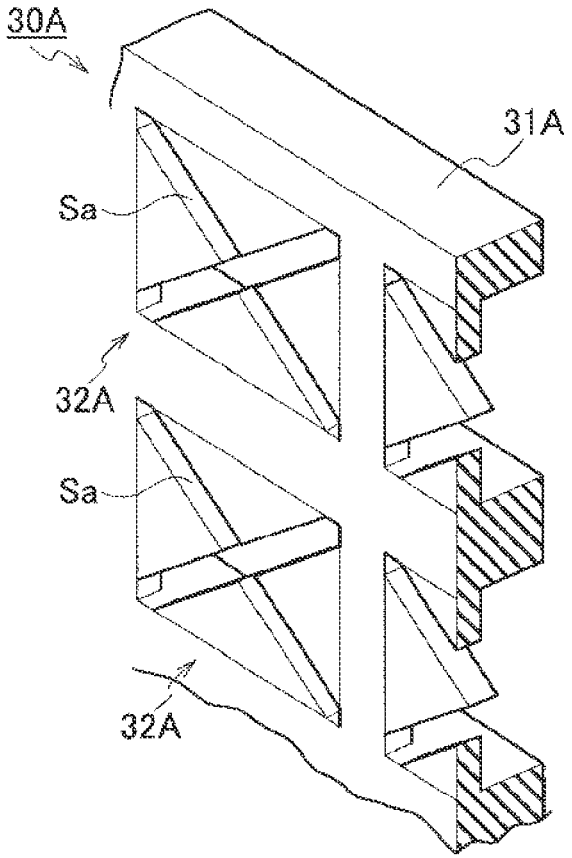
FIG. 5A is an enlarged perspective view showing a part of a plurality of slit doors 32A.
Figure 5B:
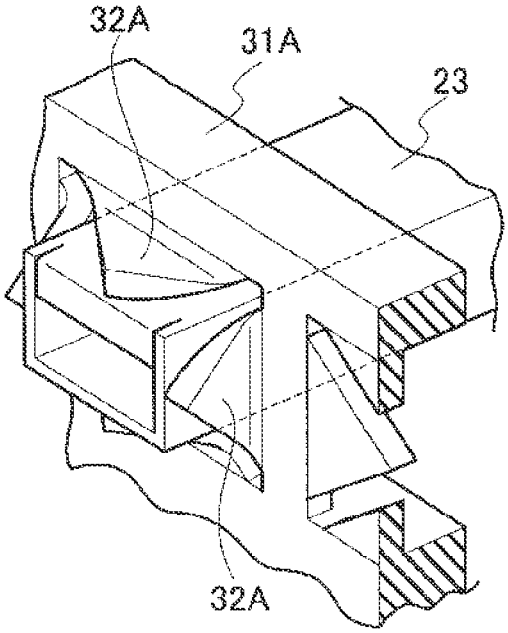
FIG. 5B is an enlarged perspective view showing a part of the plurality of slit doors 32A.
Figure 5C:
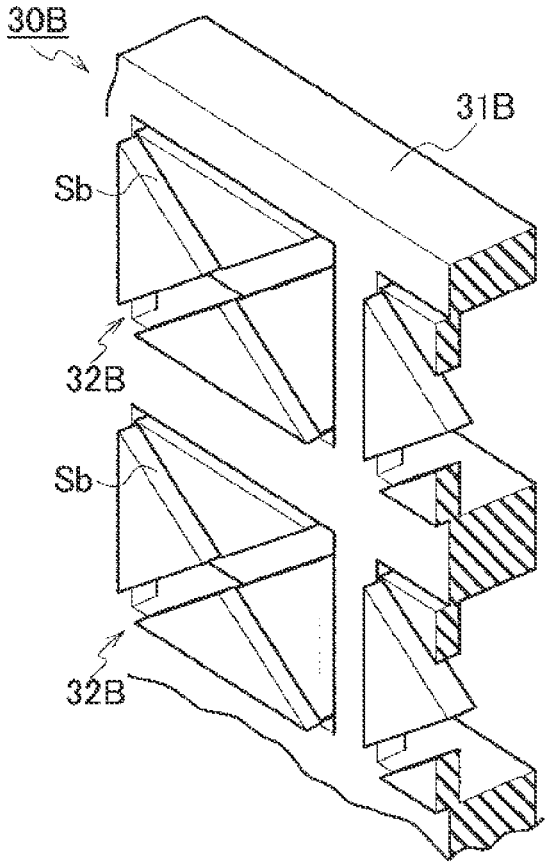
FIG. 5C is an enlarged perspective view showing a part of a plurality of slit doors 32B.
Figure 5D:
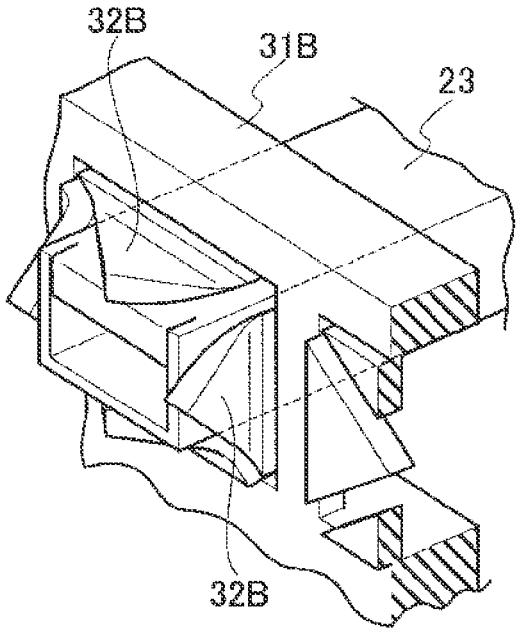
FIG. 5D is an enlarged perspective view showing a part of the plurality of slit doors 32B.

Next, a configuration of the above-mentioned spacer 30 will be described with reference to FIG. 4 and FIGS. 5A to 5D. FIG. 4 is a perspective view of the spacer 30 in accordance with the present embodiment. FIG. 5A and FIG. 5B are enlarged perspective views showing a part of the plurality of slit doors 32A, and FIG. 5C and FIG. 5D are enlarged perspective views showing a part of the plurality of slit doors 32B.

As shown in FIG. 4, the spacer 30 is arranged inside the housing 10 (that is, stored in the spacer storage chamber 13), and coats all of the plurality of terminal metal fittings 20 together. The spacer 30 includes a front-side spacer 30A as a front-side coating member located on the front-side in the inserting direction ID of the terminal metal fittings 20, and a back-side spacer 30B as a back-side coating member arranged on the back side in the inserting direction ID of the terminal metal fittings 20 with respect to the front-side spacer 30A.

The front-side spacer 30A is stored in the front-side storage portion 13A formed in the housing 10. The back-side spacer 30B is stored in the back-side storage portion 13B formed in the housing 10. The front-side spacer 30A and the back-side spacer 30B each are plate-like. The front-side spacer 30A and the back-side spacer 30B are coupled to each other via coupling side surfaces 30C rising from the front-side spacer 30A toward the back-side spacer 30B.

The front-side spacer 30A and the back-side spacer 30B include main bodies 31A and 31B fixed inside the housing 10, and the plurality of slit doors 32A and 32B formed integrally with the main bodies 31A and 31B, respectively.

The main bodies 31A and 31B are made of a resin material. On the other hand, the plurality of slit doors 32A and 32B are made of a rubber material, and are provided in the main bodies 31A and 31B. Specifically, as shown in FIG. 4 and FIGS. 5A to 5D, the slit doors 32A and 32B are formed to be substantially rectangular, and slits Sa and Sb are diagonally formed in the slit doors 32A and 32B, respectively. That is, the slit doors 32A and 32B each are divided into a plurality of small pieces (in this embodiment, four triangular small pieces) by the slits Sa and Sb.

The slit doors 32A and 32B elastically deform in the inserting direction ID of the terminal metal fittings 20 by abutting the terminal metal fittings 20 inserted into the terminal insertion holes 11 when the terminal metal fittings 20 pass therethrough. After that, when the terminal metal fittings 20 are attached to the housing 10, the slit doors 32A and 32B are brought into contact (close contact) with the terminal metal fittings 20. That is, the slit doors 32A and 32B act as check valves.

When the terminal metal fittings 20 are attached to the housing 10, the slit doors 32A are located on the front side in the inserting direction ID of the terminal metal fittings 20 with respect to the caulked portions 22 and the front crimped portions 23 of the terminal metal fittings 20. When the terminal metal fittings 20 are attached to the housing 10, the slit doors 32B are located on the front side in the inserting direction ID of the terminal metal fittings 20 with respect to the front crimped portions 23 of the terminal metal fittings 20. Moreover, the arrangement and the number of the slit doors 32A and 32B are the same as those of the terminal insertion holes 11. That is, the slit doors 32A and 32B correspond to the terminal insertion holes 11 in the state where the spacer 30 is stored in the spacer storage chamber 13.

(3) Movement of Slit Doors

Figure 6:
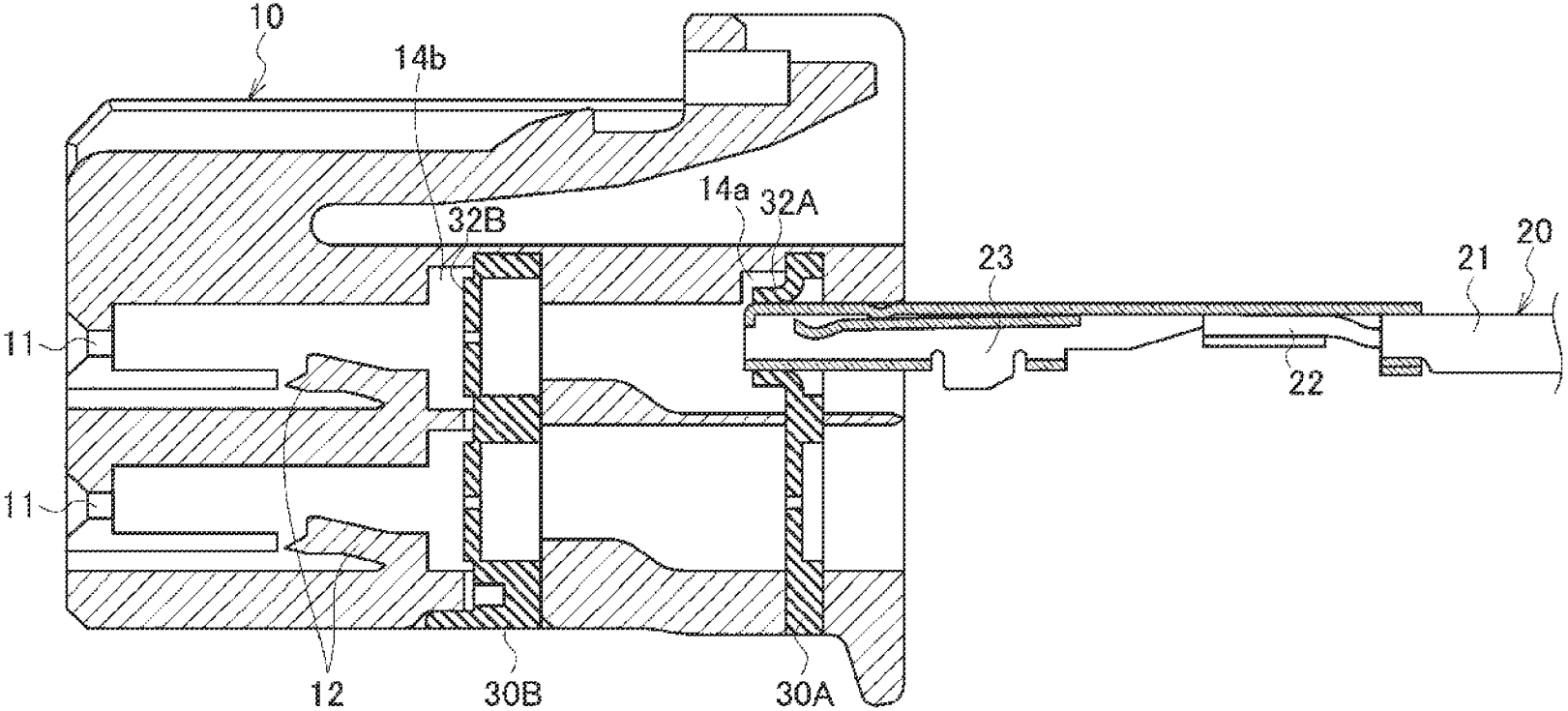
FIG. 6 is a sectional view showing a state where a terminal metal fitting 20 is inserted into a slit door 32A.
Figure 7:
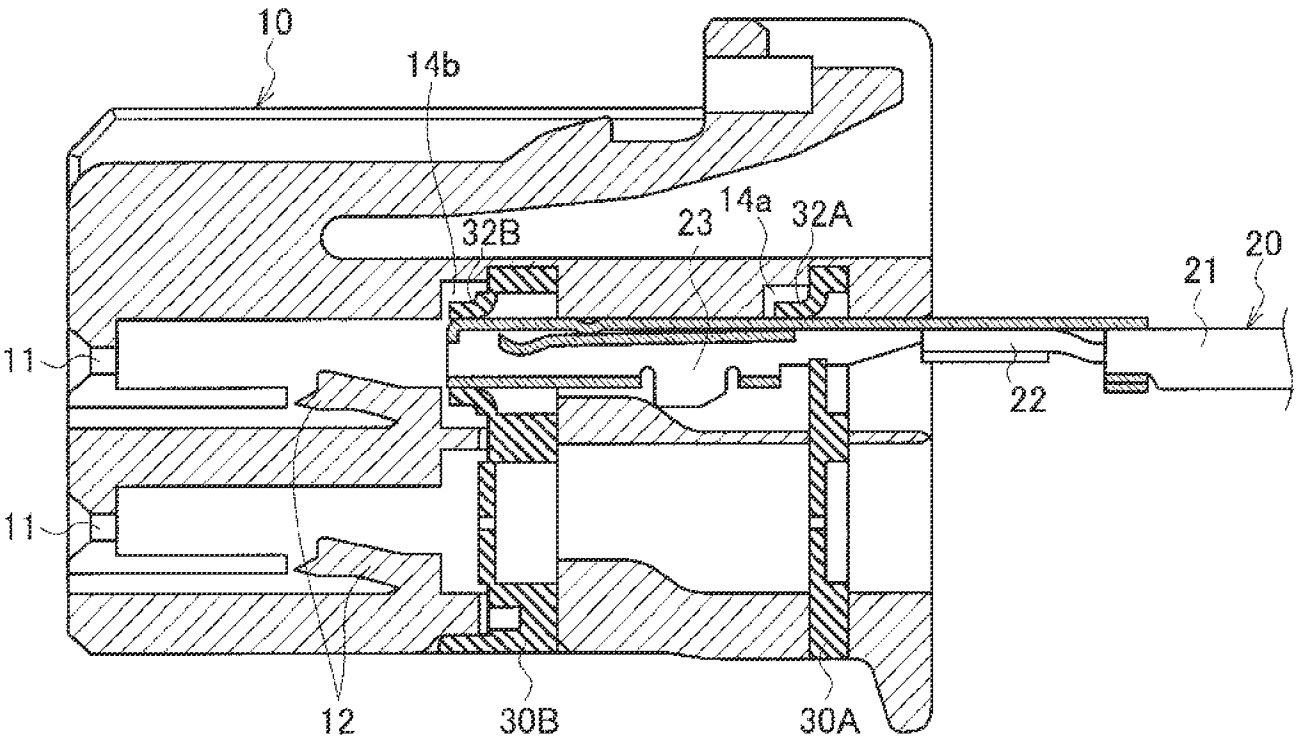
FIG. 7 is a sectional view showing a state where the terminal metal fitting 20 having passed through the slit door 32A is inserted into a slit door 32B.
Figure 8:
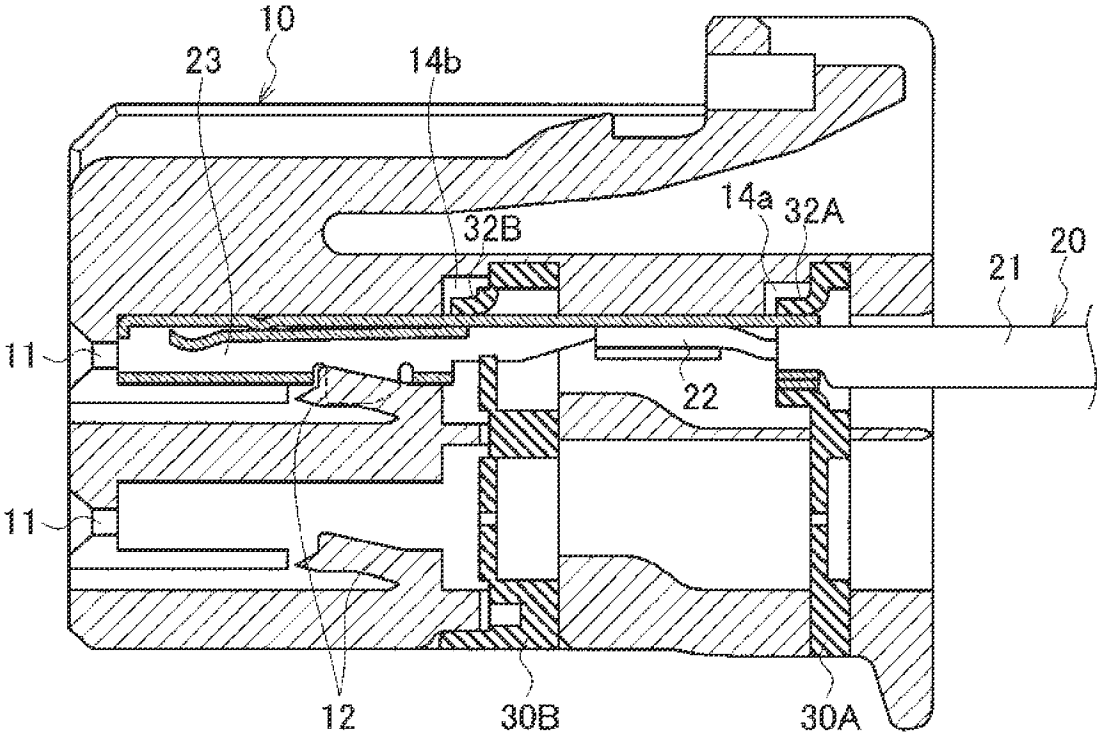
FIG. 8 is a sectional view showing a state where the terminal metal fitting 20 is completely attached into a terminal insertion hole 11 of the connector 1.

Next, movement of the above-mentioned slit doors 32A and 32B will be described with reference to FIG. 6 to FIG. 8. FIG. 6 is a sectional view showing a state where the terminal metal fitting 20 is inserted into the slit door 32A. FIG. 7 is a sectional view showing a state where the terminal metal fitting 20 having passed through the slit door 32A is inserted into the slit door 32B. FIG. 8 is a sectional view showing a state where the terminal metal fitting 20 is completely attached into the terminal insertion hole 11 of the connector 1.

As shown in FIG. 6, when the terminal metal fittings 20 are inserted into the respective terminal insertion holes 11 of the connector 1, the terminal metal fittings 20 pass through the slit doors 32A of the front-side spacer 30A. At this time, the slit doors 32A elastically deform in the inserting direction ID of the terminal metal fittings 20 by abutting the front crimped portions 23 of the terminal metal fittings 20. In other words, the slit doors 32A are turned up in the door deformable spaces 14*a*.

Next, as shown in FIG. 7, the terminal metal fittings 20 having passed through the slit doors 32A of the front-side spacer 30A pass through the slit doors 32B of the back-side spacer 30B. At this time, the slit doors 32B elastically deform in the inserting direction ID of the terminal metal fittings 20 by abutting the front crimped portions 23 of the terminal metal fittings 20. In other words, the slit doors 32B are turned up in the door deformable spaces 14*b*. At this time, after passage of the front crimped portions 23 of the terminal metal fittings 20, the slit doors 32A are brought into close contact with the terminal metal fittings 20 (caulked portions 22) by a restoring force.

Next, as shown in FIG. 8, the terminal metal fittings 20 having passed through the slit doors 32B of the back-side spacer 30B are located on the back-side of the terminal insertion holes 11 and are engaged with the respective lances 12. At this time, after passage of the front crimped portions 23 of the terminal metal fittings 20, the slit doors 32B are brought into close contact with the terminal metal fittings 20 (caulked portions 22) by a restoring force.

(4) Actions And Effects

In the above-mentioned embodiment, the slit doors 32A and 32B deform in the inserting direction of the terminal metal fittings 20 by abutting the terminal metal fittings 20 when the terminal metal fittings 20 inserted into the terminal insertion holes 11 pass therethrough, and are brought into contact (close contact) with the terminal metal fittings 20 when the terminal metal fittings 20 are attached to the housing 10. For this reason, the entry of moisture into the connector 1 (in particular, the terminal metal fittings 20) can be prevented by means of the spacer 30 without using the conventional rubber packing and sealing member. As a result, since there is no need to crimp the sealing member or the like to each of the terminal metal fittings 20, corrosion or the like of the terminal metal fittings 20 in the connector 1 is suppressed (so-called anticorrosion), which prevents overspecification. In addition, since the conventional operation of attaching the rubber packing and the sealing member is not required, the manufacturing costs for the connector 1 can be reduced.

Furthermore, the slit doors 32A and 32B are divided into the plurality of small pieces by the slits Sa and Sb. Thus, since the slit doors 32A and 32B can be easily deformed, the terminal metal fittings 20 are easy to pass through the slit doors 32A and 32B. For this reason, the terminal metal fittings 20 can be easily inserted into the terminal insertion holes 11, thereby facilitating the operation of attaching the terminal metal fittings 20 to the housing 10.

In the present embodiment, the main bodies 31A and 31B are made of resin material, and the slit doors 32A and 32B are made of rubber material. Thus, since relatively inexpensive materials can be adopted, the manufacturing costs for the connector 1 can be further reduced.

In the present embodiment, the spacer 30 includes the front-side spacer 30A and the back-side spacer 30B. With this configuration, the front-side spacer 30A can prevent the entry of moisture from the openings of the terminal insertion holes 11, and even when the moisture passes through the front-side spacer 30A, the back-side spacer 30B can prevent the entry of the moisture. For this reason, corrosion or the like of the terminal metal fittings 20 in the connector 1 can be suppressed more reliably.

In the present embodiment, the slit doors 32A are provided on the front side in the inserting direction ID of the terminal metal fittings 20 with respect to the caulked portions 22 and the front crimped portions 23 of the terminal metal fittings 20 when the terminal metal fittings 20 are attached to the housing 10. The slit doors 32B are provided on the front side in the inserting direction ID of the terminal metal fittings 20 with respect to the front crimped portions 23 of the terminal metal fittings 20 when the terminal metal fittings 20 are attached to the housing 10. Thereby, the entry of moisture into the front crimped portions 23 of the terminal metal fittings 20 can be prevented by the slit doors 32A and 32B more reliably.

In the present embodiment, the plurality of slit doors 32A and 32B is formed integrally with the main bodies 31A and 31B. Thereby, at molding the main bodies 31A and 31B, the plurality of slit doors 32A and 32B can be formed at the same time. As compared to the case where the plurality of slit doors 32A and 32B is formed separately from the main bodies 31A and 31B, the manufacturing costs of the connector 1 can be reduced, and the entry of moisture from the openings of the terminal insertion holes 11 can be prevented more reliably.

(5) Other Embodiments

As described above, contents of the present invention are disclosed based on the embodiment of the present invention, but it should not be understood that the description and drawings that constitute a part of this disclosure limit the present invention. From this disclosure, various alternative modes, embodiments and operating techniques become apparent to a person skilled in the art.

For example, the embodiment of the present invention can be changed as follows. Specifically, although the connector 1 has been described as the female connector, the present invention is not limited to this, and the connector 1 may be a male connector.

In addition, although the spacer 30 is made of resin or rubber in the above description, the present invention is not limited to this, and the spacer 30 may be made of any material as long as it can be elastically deformed.

Moreover, although the front-side spacer 30A and the back-side spacer 30B each are plate-like so as to be orthogonal to the inserting direction ID of the terminal metal fittings 20 in the above-description, the present invention is not limited to this, and the front-side spacer 30A and the back-side spacer 30B may have other shape (for example, the front-side spacer 30A and the back-side spacer 30B are completely integrated in the shape of a box). Furthermore, although the front-side spacer 30A and the back-side spacer 30B are coupled to each other via the coupling side surfaces 30C in the above-description, the present invention is not limited to this, and the front-side spacer 30A and the back-side spacer 30B may be separated from each other.

Furthermore, although the spacer 30 includes the front-side spacer 30A and the back-side spacer 30B in the above description, the present invention is not limited to this, and the spacer 30 may be a single spacer.

Moreover, although the slit doors 32A and 32B are formed to be substantially rectangular in the above description, the present invention is not limited to this, the slit doors 32A and 32B may be any shape (for example, substantially circular). Similarly, although the slit doors 32A and 32B are divided into the four triangular regions by the slits Sa and Sb in the above description, the present invention is not limited to this, the slit doors 32A and 32B may be divided into a plurality of small pieces of other shape.

Furthermore, although the slit doors 32A are provided on the front side in the inserting direction ID of the terminal metal fittings 20 with respect to the caulked portions 22 and the front crimped portions 23 of the terminal metal fittings 20 when the terminal metal fittings 20 are attached to the housing 10, and the slit doors 32B are provided on the front side in the inserting direction ID of the terminal metal fittings 20 with respect to the front crimped portions 23 of the terminal metal fittings 20 when the terminal metal fittings 20 are attached to the housing 10 in the above description, the present invention is not limited to this, and the slit doors only need to be provided on the front side in the inserting direction ID of the terminal metal fittings 20 with respect to the front crimped portions 23.

In addition, although the main bodies 31A and 31B are made of resin material and the slit doors 32A and 32B are made of rubber material in the above description, the present invention is not limited to this, at least the slit doors 32A and 32B need to be made of an elastically deformable material.

Moreover, although the plurality of slit doors 32A and 32B is formed integrally with the main bodies 31A and 31B, respectively, in the above description, the present invention is not limited to this, the slit doors 32A and 32B may be formed separately from the main bodies 31A and 31B, respectively.

Furthermore, although the depth dimension M11 of the terminal insertion holes 11 is formed to be larger than the dimension M22 of the front crimped portions 23 of the terminal metal fittings 20, the present invention is not limited to this, and the depth dimension M11 may be equal to the dimension M22 as long as the slit doors 32A and 32B are in close contact with the caulked portions 22 of the terminal metal fittings 20.

As described above, it is needless to say that the present invention includes various embodiments that are not described herein. Therefore, the technical scope of the present invention is defined by only subject matters according to Claims, which are considered reasonable from the above-mentioned description.

What is claimed is:

1. A connector comprising:

a housing formed with a plurality of terminal insertion holes into which a plurality of terminals is inserted, respectively;

a coating member arranged inside the housing and coating the plurality of terminals; and a storage chamber having an opening provided on a lower surface of the housing configured to accommodate the coating member through the opening on the lower surface, the opening being between a front surface and a rear surface of the housing serving as insertion ends of the housing, wherein the coating member includes a main body fixed inside the housing, and a plurality of slit doors provided in the main body and divided into a plurality of small pieces by a plurality of slits, and wherein each of the slit doors elastically deforms by abutting a terminal of the plurality of terminals inserted into the terminal insertion hole when the terminal passes therethrough, and is brought into contact with the terminal when the terminal is attached to the housing.

2. The connector according to claim 1, wherein the coating member is configured to have the terminal inserted into at least two slit doors.

3. The connector according to claim 1, wherein the housing has a slit door deformable space provided between the coating member and a lance portion.

4. A connector comprising:

a housing formed with a plurality of terminal insertion holes into which a plurality of terminals is inserted, respectively; and a coating member arranged inside the housing and coating the plurality of terminals, wherein the coating member includes a main body fixed inside the housing, and a plurality of slit doors provided in the main body and divided into a plurality of small pieces by a plurality of slits, wherein each of the slit doors elastically deforms by abutting a terminal of the plurality of terminals inserted into the terminal insertion hole when the terminal passes therethrough, and is brought into contact with the terminal when the terminal is attached to the housing, and wherein the main body is made of a resin material and the plurality of slit doors is made of a rubber material.

5. A connector comprising:

a housing formed with a plurality of terminal insertion holes into which a plurality of terminals is inserted, respectively; and a coating member arranged inside the housing and coating the plurality of terminals, wherein the coating member includes a main body fixed inside the housing, and a plurality of slit doors provided in the main body and divided into a plurality of small pieces by a plurality of slits, wherein each of the slit doors elastically deforms by abutting a terminal of the plurality of terminals inserted into the terminal insertion hole when the terminal passes therethrough, and is brought into contact with the terminal when the terminal is attached to the housing, and wherein the coating member is formed of:

a front-side coating member arranged on a front-side in an inserting direction of the terminals, and a back-side coating member arranged on a back-side in the inserting direction of the terminals with respect to the front-side coating member.

6. A coating member comprising:

a main body configured to be accommodated in a storage chamber provided on a lower surface of a housing of a connector; and a plurality of slit doors provided in the main body and divided into a plurality of small pieces by a plurality of slits, wherein each of the slit doors elastically deforms by abutting a terminal inserted into a terminal insertion hole of the connector when the terminal passes therethrough, and is brought into contact with the terminal when the terminal is attached to the housing, Wherein the main body is made of a resin material and the plurality of slit doors is made of a rubber material.

* * * * *